US010927436B2

(12) United States Patent
Hu

(10) Patent No.: US 10,927,436 B2
(45) Date of Patent: Feb. 23, 2021

(54) ALUMINUM ALLOYS

(71) Applicant: GM GLOBAL TECHNOLOGY OPERATIONS LLC, Detroit, MI (US)

(72) Inventor: Bin Hu, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/486,397

(22) PCT Filed: Mar. 9, 2017

(86) PCT No.: PCT/CN2017/076146
§ 371 (c)(1),
(2) Date: Aug. 15, 2019

(87) PCT Pub. No.: WO2018/161311
PCT Pub. Date: Sep. 13, 2018

(65) Prior Publication Data

US 2020/0002788 A1 Jan. 2, 2020

(51) Int. Cl.
*C22C 21/02* (2006.01)
*C22F 1/043* (2006.01)

(52) U.S. Cl.
CPC ..... *C22C 21/02* (2013.01); *C22F 1/043* (2013.01)

(58) Field of Classification Search
None
See application file for complete search history.

(56) References Cited

U.S. PATENT DOCUMENTS 4,975,243 A * 12/1990 Scott ..... C22C 21/02 148/438
5,837,070 A 11/1998 Sainfort et al.
(Continued)

FOREIGN PATENT DOCUMENTS

CN 102268577 A 12/2011
CN 102301021 A 12/2011
(Continued)

OTHER PUBLICATIONS

International Search Report and Written Opinion for International Application No. PCT/CN2015/074554 dated Dec. 23, 2015, 6 pages (ISA/CN).
(Continued)

*Primary Examiner* — Daniel J. Schleis
(74) *Attorney, Agent, or Firm* — Hamess, Dickey & Pierce, P.L.C.

(57) ABSTRACT

An aluminum alloy consisting essentially of from greater than 6 wt % to about 12.5 wt % silicon; iron present in an amount up to 0.15 wt %; from about 0.1 wt % to about 0.4 wt % chromium; from about 0.1 wt % to about 3 wt % copper; from about 0.1 wt % to about 0.5 wt % magnesium; from about 0.05 wt % to about 0.1 wt % titanium; less than 0.01 wt % of strontium; and a balance of aluminum and inevitable impurities. The aluminum alloy contains no vanadium. A method for increasing ductility and strength of an aluminum alloy without using vacuum and a T7 heat treatment, the method comprising: casting the molten aluminum alloy by a high pressure die-cast process to form a cast structure. The structural castings formed of the aluminum alloy composition disclosed herein exhibit desirable mechanical properties, such as high strength and high ductility/elongation.

11 Claims, 1 Drawing Sheet

(56) References Cited

U.S. PATENT DOCUMENTS

| | | | | |
|---|---|---|---|---|
| 5,948,185 | A | 9/1999 | Krajewski et al. | |
| 6,045,636 | A | 4/2000 | Krajewski | |
| 6,669,792 | B2 | 12/2003 | Lee et al. | |
| 6,811,625 | B2 | 11/2004 | Verma | |
| 7,216,927 | B2 | 5/2007 | Luo et al. | |
| 7,967,928 | B2 | 6/2011 | Luo et al. | |
| 8,163,113 | B2 | 4/2012 | Mishra et al. | |
| 8,287,966 | B2 | 10/2012 | Sundarraj et al. | |
| 8,327,910 | B2 | 12/2012 | Walker et al. | |
| 8,708,425 | B2 | 4/2014 | Carlson et al. | |
| 8,852,359 | B2 | 10/2014 | Walker et al. | |
| 8,889,226 | B2 | 11/2014 | Walker et al. | |
| 8,992,696 | B2 | 3/2015 | Walker et al. | |
| 9,352,388 | B2 | 5/2016 | Hu et al. | |
| 9,481,034 | B2 | 11/2016 | Chen et al. | |
| 9,593,396 | B2 | 3/2017 | Luo et al. | |
| 9,700,976 | B2 | 7/2017 | Gao et al. | |
| 9,771,635 | B2 | 9/2017 | Wang et al. | |
| 10,086,429 | B2 | 10/2018 | Hu et al. | |
| 10,323,304 | B2 | 6/2019 | Greven et al. | |
| 2004/0011437 | A1 | 1/2004 | Lin et al. | |
| 2006/0027291 | A1* | 2/2006 | Matsuoka | C22F 1/047 148/550 |
| 2007/0269337 | A1 | 11/2007 | Luo et al. | |
| 2008/0096039 | A1 | 4/2008 | Sachdev et al. | |
| 2009/0071620 | A1 | 3/2009 | Bharadwaj et al. | |
| 2010/0163137 | A1 | 7/2010 | Wurker et al. | |
| 2010/0288401 | A1 | 11/2010 | Hennings et al. | |
| 2011/0089749 | A1 | 4/2011 | Kleber et al. | |
| 2011/0286880 | A1 | 11/2011 | Luo et al. | |
| 2012/0168041 | A1 | 7/2012 | Horikawa et al. | |
| 2012/0273539 | A1 | 11/2012 | Carter | |
| 2014/0017115 | A1 | 1/2014 | Wang et al. | |
| 2014/0056755 | A1 | 2/2014 | Greven et al. | |
| 2014/0140886 | A1* | 5/2014 | Speckert | C22F 1/043 420/532 |
| 2014/0230230 | A1 | 8/2014 | Gao et al. | |
| 2015/0071815 | A1 | 3/2015 | Wiesner et al. | |
| 2015/0315688 | A1 | 11/2015 | Doty | |
| 2017/0191146 | A1 | 7/2017 | Greven et al. | |
| 2018/0057913 | A1 | 3/2018 | Hu | |
| 2018/0126452 | A1 | 5/2018 | Gao et al. | |
| 2018/0127859 | A1 | 5/2018 | Hu et al. | |
| 2019/0024226 | A1 | 1/2019 | Hu et al. | |
| 2019/0118251 | A1 | 4/2019 | Hu et al. | |

FOREIGN PATENT DOCUMENTS

| | | | | |
|---|---|---|---|---|
| CN | 102676887 | A | | 9/2012 |
| CN | 103572111 | A | | 2/2014 |
| CN | 104878256 | A | | 9/2015 |
| CN | 108699640 | A | | 10/2018 |
| CN | 110402295 | A | | 11/2019 |
| DE | 102006039684 | A1 | | 2/2008 |
| DE | 102009012073 | | * | 9/2009 |
| DE | 102009012073 | A1 | | 9/2010 |
| DE | 102010055444 | A1 | | 6/2012 |
| DE | 112016006624 | T5 | | 12/2018 |
| DE | 12017007033 | T5 | | 10/2019 |
| EP | 1130125 | A2 | | 9/2001 |
| JP | H116024 | | * | 1/1999 |
| JP | 2001200326 | A | | 7/2001 |
| JP | 2001288547 | A | | 10/2001 |
| JP | 2006283124 | | * | 10/2006 |
| JP | 2012087352 | A | | 5/2012 |
| WO | WO2015118312 | | * | 11/2015 |
| WO | 2016015711 | A1 | | 2/2016 |
| WO | 2016145644 | A1 | | 9/2016 |
| WO | 2017181351 | A1 | | 10/2017 |
| WO | 2017185321 | A1 | | 11/2017 |
| WO | 2017210916 | A1 | | 12/2017 |
| WO | 2018103065 | A1 | | 6/2018 |

OTHER PUBLICATIONS

International Search Report and Written Opinion for International Application No. PCT/CN2016/079695 dated Dec. 21, 2016, 8 pages (ISA/CN).

International Search Report and Written Opinion for International Applicaiton No. PCT/CN2017/076146 dated Nov. 22, 2017, 13 pages (ISA/CN).

"Aluminum Oil Tube Cast-in-Place for Oil Pans," Research Disclosure, Database No. 605037 (Published online Aug. 15, 2014).

Chen, Z.W., "Formation and progression of die soldering during high pressure die casting," Materials Science adn Engineering A, 397 (2005), pp. 356-369; DOI: 10.1016/j.msea.2005.02.057.

Kim, Hyun You et al., "The influence of Mn and Cr on the tensile properties of A356-0.20Fe alloy," Materials Letters, 60 (2006), pp. 1880-1883 (Published online Jan. 20, 2006); DOI: 10.1016/j.matlet.2005.12.042.

First Office Action for Chinese Patent Application No. 201680083371.8 dated Sep. 27, 2019 with English language machine translation, 16 pages.

* cited by examiner

ALUMINUM ALLOYS

CROSS REFERENCE TO RELATED APPLICATIONS

This application is a U.S. National Phase Application under 35 U.S.C. 371 of International Application No. PCT/CN2017/076146 filed on Mar. 9, 2017 and published in English as WO 2018/161311 A1 on Sep. 13, 2018. The entire disclosure of the above application is incorporated herein by reference.

INTRODUCTION

Die casting processes are commonly used to form high volume automobile components. In particular, aluminum alloys are often used to form the structural components in the die casting process because aluminum alloys have many favorable properties, such as light weight and high dimensional stability, which allows the formation of more complex and thin wall components compared to other alloys. Traditionally, aluminum die castings have a limitation on ductility due to air entrapment and Fe-intermetallic phases. Many technologies developed for reducing these issues, such as semisolid die casting and super-vacuum die casting, form porosity-free castings.

SUMMARY

In an example, an aluminum alloy consists essentially of from greater than 6 wt % to about 12.5 wt % silicon, iron present in an amount up to 0.15 wt %, from about 0.1 wt % to about 0.4 wt % chromium, from about 0.1 wt % to about 3 wt % copper, from about 0.1 wt % to about 0.5 wt % magnesium, from about 0.05 wt % to about 0.1 wt % titanium, less than 0.01 wt % strontium, and a balance of aluminum and inevitable impurities. The aluminum alloy contains no vanadium.

In another example, a chassis component for an automobile is disclosed. The chassis component comprises an aluminum alloy, which consists essentially of: from greater than 6 wt % to about 12.5 wt % silicon; iron present in an amount up to 0.15 wt %; from about 0.1 wt % to about 0.4 wt % chromium; from about 0.1 wt % to about 3 wt % copper; from about 0.1 wt % to about 0.5 wt % magnesium; from about 0.05 wt % to about 0.1 wt % titanium; less than 0.01 wt % strontium; and a balance of aluminum and inevitable impurities; wherein the aluminum alloy contains no vanadium.

An example of method for increasing ductility and strength of an aluminum alloy without using vacuum and a T7 heat treatment is also disclosed. In an example, the method comprises forming the aluminum alloy in a molten state, the aluminum alloy consisting essentially of: from about 7.5 wt % to about 12.5 wt % silicon; iron present in an amount up to 0.15 wt %; from about 0.1 wt % to about 0.4 wt % chromium; from about 0.1 wt % to about 3 wt % copper; from about 0.1 wt % to about 0.5 wt % magnesium; from about 0.05 wt % to about 0.1 wt % titanium; less than 0.01 wt % strontium; 0 wt % vanadium; and a balance of aluminum and inevitable impurities. The method further comprises casting the molten aluminum alloy by a high pressure die-cast process to form a cast structure.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figures 1A, 1B:
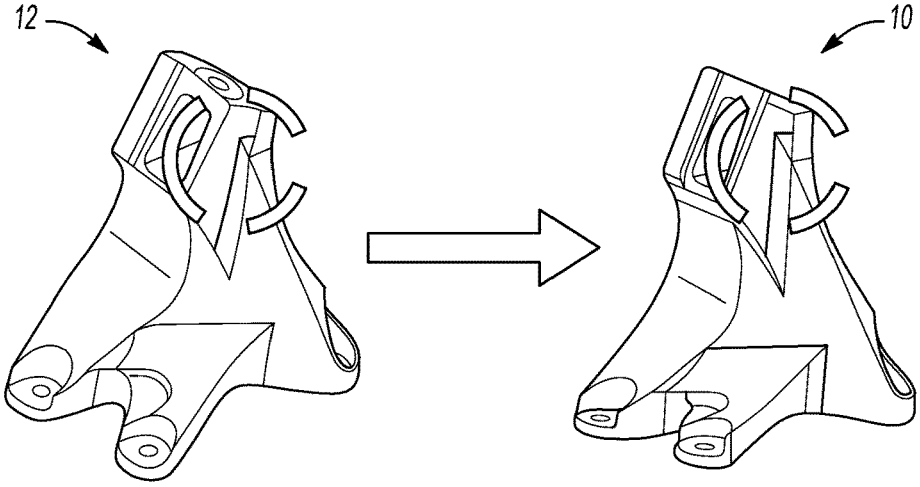
FIGS. 1A and 1B are schematic, perspective views of example engine mount designs for an A380 alloy and for an example of the aluminum alloy disclosed herein, respectively.

Aluminum alloys often include aluminum, alloying elements (e.g., silicon and iron), and impurities. In the examples disclosed herein, it has been found that the particular elements in the particular amounts form an alloy (also referred to as an alloy composition) that, after being cast and exposed to a T5 heat treatment, exhibits high strength (e.g., an average yield strength of at least 200 MPa and ultimate tensile strength of at least 300 MPa) and relatively high ductility (e.g., elongation ranging from about 7% to about 10%). In other words, the as-cast and T5 treated structure of the aluminum alloy has a percent elongation ranging from about 7% to about 10% and a yield strength ranging from about 200 MPa to about 250 MPa. This as-cast and T5 treated structure may also be a thin-wall casting. These characteristics are achievable without utilizing super-vacuum and without utilizing a T7 solution based heat treatment. Without this additional, solution based heat treatment, the risk of deformation of the structural casting is reduced, and the cost of production of the structural casting is reduced.

The example alloys disclosed herein consist essentially of silicon (Si), iron (Fe), chromium (Cr), copper (Cu), magnesium (Mg), titanium (Ti), strontium (Sr), a balance of aluminum (Al), and inevitable impurities. The example alloys disclosed herein do not include vanadium (V). In some instances, particular element(s) may not be intentionally added to the alloy, but may be present in a small amount that equates to an inevitable impurity. For example, phosphorus (P), zinc (Zn), and zirconium (Zr) are examples of inevitable impurities that may not be added to the alloy on purpose but are present nonetheless. In the examples disclosed herein, the combination of the elements in the specific amounts generates an aluminum alloy that is suitable for casting aluminum components with a lightweight design, and yet with high strength.

Moreover, since the aluminum alloys disclosed herein generate parts (i.e., castings, structural bodies) that are of desirable mechanical properties without vacuum or solution heat treatment(s), the amount of the alloy needed to form the parts may be reduced, when compared to other alloys that require more of the particular alloy to achieve suitable mechanical properties. Examples of part reconfigurations that can be made with the alloys disclosed herein are shown in FIGS. 1A through 3B, and will be discussed further herein below.

Throughout this disclosure, it is to be understood that when a lower limit for a range is not given (e.g., "up to X wt % element" or "less than X wt % element"), the lower limit is 0 wt %, and thus the particular element may not be present in the alloy. However, when it is stated that an element "is present in an amount up to X wt %", the lower limit is greater than 0 wt %, and at least some of the element is present in the alloy.

As mentioned above, examples of the aluminum alloy composition disclosed herein may consist essentially of silicon (Si), iron (Fe), chromium (Cr), copper (Cu), magnesium (Mg), titanium (Ti), strontium (Sr), a balance of aluminum (Al), and inevitable impurities. Examples of the inevitable impurities include phosphorus (P), zinc (Zn), and/or zirconium (Zr). While some examples of inevitable impurities have been mentioned, it is to be understood that other inevitable impurities may be present in these examples of the alloy composition. In other examples, the aluminum alloy composition disclosed herein may consist of silicon (Si), iron (Fe), chromium (Cr), copper (Cu), magnesium (Mg), titanium (Ti), strontium (Sr), a balance of aluminum (Al), and inevitable impurities selected from the group consisting of phosphorus (P), zinc (Zn), and combinations thereof. In these examples, the alloy composition consists of these metals and semi-metals, without any other metals or semi-metals. Further, in any of the examples disclosed herein, the alloy composition excludes vanadium (V), but may also exclude zirconium (Zr), manganese (Mn), or combinations thereof, or any other non-listed elements. Examples of the metals and semi-metals added to the alloy composition disclosed herein are discussed in greater detail below.

The aluminum alloy composition is made up of silicon. Silicon may be added to the alloy to reduce the melting temperature of the aluminum and to improve the fluidity of the molten aluminum. The silicon may improve the castability of the alloy, rending it suitable for being cast into dies used to form either thin-walled components (e.g., having a wall thickness equal to or less than 5 mm) or thick-walled components (e.g., having a wall thickness greater than 5 mm). While the aluminum alloy may be used to form any desired aluminum alloy based component, the castability of the alloy (due, at least in part, to the silicon content) may be particularly suitable for forming thin-walled components. In the examples disclosed herein, silicon is included in an amount greater than 6 wt %. When the silicon content is higher than 6 wt %, the castability is improved (e.g., improved fluidity, reduced hot cracking, etc.), which renders the composition well suited for thin-wall casting. In an example, the silicon may be present in the alloy composition in an amount ranging from greater than 6 wt % to about 12.5 wt % based on the total wt % of the aluminum alloy composition. In other examples, the silicon may be present in an amount ranging from greater than 6 wt % to about 9.5 wt %, or an amount ranging from about 7.5 wt % to about 12.5 wt %, or an amount ranging from about 7.5 wt % to about 9.5 wt %. In still another example, the silicon may be present in an amount ranging from about 8 wt % to about 9 wt %. Increasing the silicon may deleteriously affect the ductility/elongation, and reducing the silicon may deleteriously affect the castability (and thus the composition's suitability for making thin-walled components).

The aluminum alloy composition is also made up of iron. Some iron may be added to improve yield strength and/or tensile strength of the structural casting formed from the die casting of the aluminum alloy. Iron is also included for improving ductility. In an example, the iron may be present in an amount less than 0.15 wt % based on the total wt % of the aluminum alloy composition. In another example, the iron may be present in an amount of equal to or less than 0.1 wt % of the alloy composition. It is to be understood that the wt % of iron is greater than 0 wt %, and thus at least some iron is present in the aluminum alloy composition.

Further, the aluminum alloy composition is made up of chromium. The specific amount of chromium contributes to the reduction in the solubility of iron in molten aluminum. Reducing the iron solubility, and thus the amount of dissolved iron in the molten aluminum, also reduces the amount of iron-intermetallics that form as a result of the molten aluminum reacting with the dissolved iron. These iron-intermetallics can stick to the die used in casting, which results in die soldering. When die soldering occurs, the surface finish of the resulting part (i.e., casting, structural body) may be destroyed when ejected from the die, and the die life may be reduced as well. As such, the addition of chromium reduces die soldering, improves part aesthetics, and may increase the die life. The specific amount of chromium also does not deleteriously affect the ductility and/or yield strength of the final structural casting formed from the aluminum alloy composition(s). As such, the addition of the specific amount of chromium may also contribute to the lack of a need for an additional heat treatment (e.g., T7) of the structural casting after the die casting process. Chromium may also improve toughness of the structural casting formed from the die casting of the aluminum alloy. In an example, chromium may be present in the aluminum alloy composition in an amount ranging from about 0.1 wt % to about 0.4 wt % based on the total wt % of the aluminum alloy composition. In another example, the chromium may be present in an amount ranging from about 0.25 wt % to about 0.35 wt %. In still another example, the chromium may be present in an amount of about 0.3 wt %.

The aluminum alloy composition is also made up of copper. Without being bound by any theory, it is believed that copper improves the yield strength and the ultimate tensile strength by precipitating after the T5 heat treatment is performed. Copper may be present in an amount ranging from about 0.1 wt % to about 3 wt % based on the total wt % of the aluminum alloy composition. In another example, the copper may be present in an amount ranging from greater than 0.3 wt % to about 3 wt %. Still further, in another example, the copper may be present in an amount ranging from about 0.5 wt % to about 1.5 wt %.

The aluminum alloy composition is also composed of magnesium. Magnesium improves the yield strength by solid solution strengthening. Magnesium may be present in an amount ranging from about 0.1 wt % to about 0.5 wt % based on the total wt % of the alloy composition. In another example, the magnesium may be present in an amount ranging from about 0.2 wt % to about 0.5 wt %. Still further, in another example, the magnesium may be present in an amount of about 0.3 wt %.

The aluminum alloy composition is also made up of titanium. Titanium may be added as a grain refiner to improve the control of the grain growth of the molten aluminum during the die casting process. Controlling the grain growth can improve the ductility of the casting and can also reduce the risk of hot cracking of the casting. In an example, the titanium may be present in an amount ranging from about 0.05 wt % to about 0.1 wt % based on the total wt % of the aluminum alloy composition. In another example, the titanium may be present in an amount ranging from about 0.07 wt % to about 0.09 wt %.

The aluminum alloy composition may also be made up of strontium. In an example, the strontium may be present in an amount less than 0.01 wt % based on the total wt % of the aluminum alloy composition.

The remainder of the aluminum alloy composition includes a balance of aluminum and inevitable impurities. In an example, the aluminum starting material used to form the aluminum in the aluminum alloy composition may be an at least substantially pure aluminum substance (e.g., 99.9% pure aluminum with less than 0.1 wt % of impurities). The impurities present in the aluminum starting material may include zinc, phosphorus, and/or zirconium. The impurities present in the aluminum starting material may also or alternatively include iron, manganese, chromium, silicon, or the like.

The impurities may be introduced in the aluminum starting material, or in another of the starting materials added to the aluminum. In the final aluminum alloy (i.e., aluminum alloy composition), the impurities may be selected from the group consisting of less than 0.01 wt % zinc, less than 0.003 wt % phosphorus, less than 0.01 wt % zirconium, and combinations thereof.

In one example of the aluminum alloy composition, the alloy consists essentially of the silicon present in an amount ranging from greater than 6 wt % to about 12.5 wt %, the iron present in an amount up to 0.15 wt %, the chromium present in an amount ranging from about 0.1 wt % to about 0.4 wt %, the copper present in an amount ranging from about 0.1 wt % to about 3 wt %, the magnesium present in an amount ranging from about 0.1 wt % to about 0.5 wt %, the titanium present in an amount ranging from about 0.05 wt % to about 0.1 wt %, less than 0.01 wt % of the strontium, and a balance of aluminum and inevitable impurities.

In one example of the aluminum alloy composition, the alloy consists essentially of the silicon present in an amount ranging from about 7.5 wt % to about 9.5 wt %, the iron present in an amount up to 0.15 wt %, the chromium present in an amount ranging from about 0.25 wt % to about 0.35 wt %, the copper present in an amount ranging from about 0.1 wt % to about 3 wt %, the magnesium present in an amount ranging from about 0.1 wt % to about 0.5 wt %, the titanium present in an amount ranging from about 0.05 wt % to about 0.1 wt %, and a balance of aluminum and inevitable impurities.

Examples of the method disclosed herein may be used for increasing ductility and strength of an aluminum alloy without using vacuum and a T7 heat treatment. In an example, the method comprises forming the aluminum alloy in a molten state, where the aluminum alloy consisting essentially of: from about 7.5 wt % to about 12.5 wt % silicon; iron present in an amount up to 0.15 wt %; from about 0.1 wt % to about 0.4 wt % chromium; from about 0.1 wt % to about 3 wt % copper; from about 0.1 wt % to about 0.5 wt % magnesium; from about 0.05 wt % to about 0.1 wt % titanium; less than 0.01 wt % strontium; 0 wt % vanadium; and a balance of aluminum and inevitable impurities. The method further comprises casting the molten aluminum alloy by a high pressure die-cast process to form a cast structure.

To form the aluminum alloy composition, the particular weight percentages of the alloying elements previously described may be added into an at least substantially pure aluminum melt (i.e., molten aluminum starting material). The method may also involve known techniques for controlling the impurity levels.

As mentioned above, the molten alloy composition disclosed herein is die cast using a high-pressure die casting (HPDC) process. During HPDC, the aluminum-based melt (i.e., molten aluminum alloy composition) is injected with a die casting machine under force using considerable pressure into a steel mold or die to form products. A dosing furnace with a degassing system may be used to hold and transfer the molten alloy composition to the die casting machine. The die casting process parameters may be varied, depending upon the die casting machine that is used, the size and/or shape of the casting, etc. In an example, the pressure during HPDC ranges from about 60 MPa to about 100 MPa. In other words, the high pressure die-cast process is carried out at a pressure of about 60 MPa to about 100 MPa.

After the aluminum alloy composition solidifies to form the structural casting, the structural casting may be removed from the die. In an example, the casting is ejected from the die. In some examples, the casting is removed using ejector pins. Since soldering is reduced during die casting, little or no scrap casting remains in the die. However, if scrap casting remains, it may be removed from the die. Even though the alloying elements and impurities are controlled, the scrap casting may not be suitable for recycling.

The structural casting may then be exposed to a T5 heat treatment. This treatment involves allowing the structural casting to naturally cool, and then artificially aging the structural casting at an elevated temperature (e.g., a temperature ranging from 150° C. to 200° C.). In an example, the cast structure is subjected to a T5 treatment at a temperature ranging from about 160° C. to about 210° C. for a time ranging from about 3 hours to about 6 hours. After the structural casting is removed from the die and exposed to the T5 heat treatment, the structural casting is not exposed to another solution based heat treatment. Even without the solution based heat treatment, the structural casting exhibits desirable mechanical properties (e.g., ductility/elongation, strength, etc.).

Additionally, the structural casting has a suitable porosity, even without being exposed to a super vacuum process. Different aluminum alloys via HPDC often have an initial porosity of about 2.5%, and then are exposed to a super vacuum process in order to reduce the porosity to less than 0.5%. The example structural casting formed from the aluminum alloy disclosed herein has an initial porosity of 1.5% or less, which is suitable for several applications. As such, the structural casting formed from the aluminum alloy disclosed herein may not be exposed to super vacuum, which may reduce production cost.

The aluminum alloy disclosed herein may be used to make a variety of structural castings or cast structures (i.e., parts, structural bodies, etc.), including thin-walled castings or parts or thick-walled casting or parts. As used herein, thin-walled parts are any components having wall thicknesses equal to or less than 5 mm. In an example, the wall thickness ranges from about 3 mm to about 5 mm. As used herein, thick-walled parts are any components having wall thicknesses greater than 5 mm. The thin-walled parts or thick-walled parts may be automobile parts, computer parts, communication parts, or consumer electronic parts. For examples of the automobile parts, the structural casting may be an aluminum-based part for the body of a vehicle, or an aluminum-based wheel. Some specific automobile parts include chassis components, such as engine mounts, shock towers, etc. The final structural casting may also be a part utilized in an elevator application.

In an example, the chassis component for an automobile comprises an example of the aluminum alloy disclosed herein, which consists essentially of: from greater than 6 wt % to about 12.5 wt % silicon; iron present in an amount up to 0.15 wt %; from about 0.1 wt % to about 0.4 wt % chromium; from about 0.1 wt % to about 3 wt % copper; from about 0.1 wt % to about 0.5 wt % magnesium; from about 0.05 wt % to about 0.1 wt % titanium; less than 0.01 wt % strontium; and a balance of aluminum and inevitable impurities; wherein the aluminum alloy contains no vanadium. The aluminum alloy that forms the chassis component may also include inevitable impurities selected from the group consisting of less than 0.01 wt % zinc, less than 0.003 wt % phosphorus, less than 0.01 wt % zirconium, and combinations thereof.

The chassis component may be an as-cast and T5 treated structure of the aluminum alloy. In this example, the as-cast and T5 treated structure has a thin-wall ranging from about 3 mm to about 5 mm.

As mentioned above, the structural castings formed of the aluminum alloy composition disclosed herein exhibit desirable mechanical properties, such as high strength and high ductility/elongation. In some examples, the yield strength (i.e., the stress at which the structural casting begins to deform plastically, in MPa measured with an extensometer) ranges from about 200 MPa to about 250 MPa; the ultimate tensile strength (i.e., the capacity of the structural casting to withstand loads tending to elongate, in MPa measured at quasi-static state) is greater than 320 MPa; and/or the percent elongation (i.e., the ability of the structural casting to stretch up to its breaking point) ranges from about 7% to about 10%.

Figures 2A, 2B:
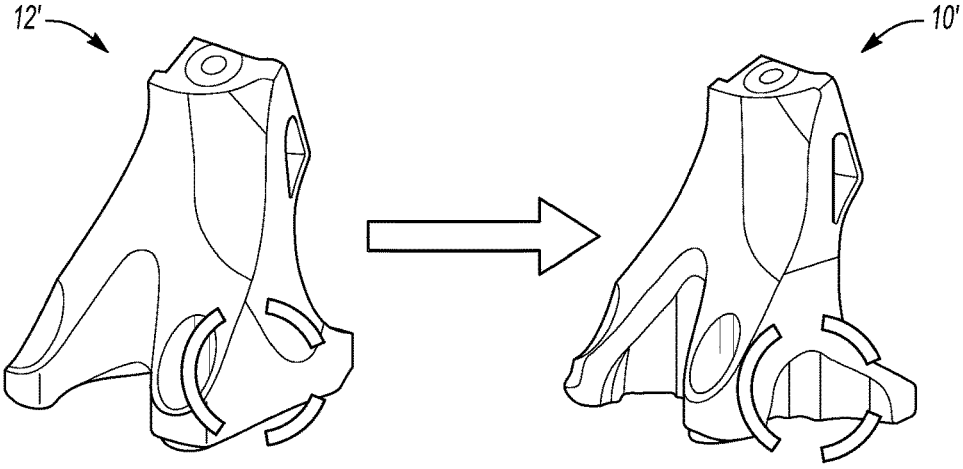
FIGS. 2A and 2B are schematic, perspective views of other example engine mount designs for an A380 alloy and for an example of the aluminum alloy disclosed herein, respectively.
Figures 3A, 3B:
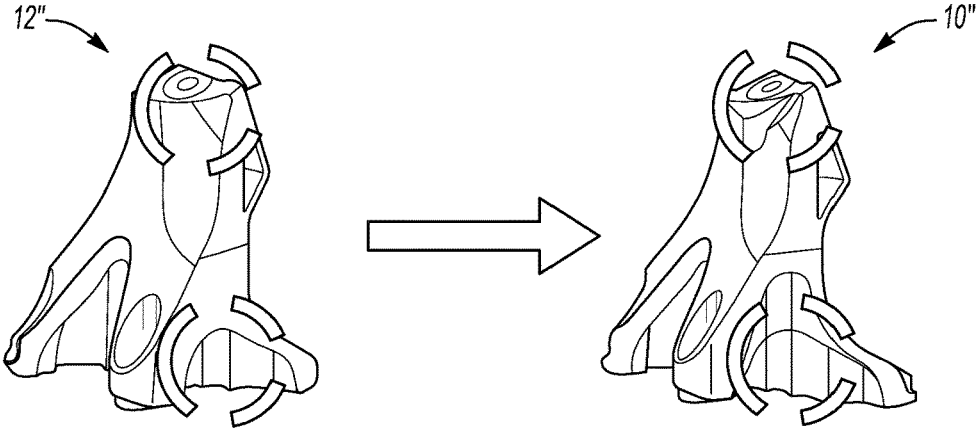
FIGS. 3A and 3B are schematic, perspective views of still other example engine mount designs for an A380 alloy and for an example of the aluminum alloy disclosed herein, respectively.

FIGS. 1B, 2B, and 3B illustrate different examples of engine mounts 10, 10', 10" (one example of a chassis component, which attaches the engine to the chassis) that may be made by examples of the aluminum alloy composition disclosed herein. The design of each of these engine mounts 10, 10', 10" is reconfigured to utilize less of the aluminum alloy composition, when compared to the design for similar engine mounts 12, 12', 12" formed from A380 (see FIGS. 1A, 2A, and 3A). Engine mounts 12, 12', 12" formed according to the designs shown in FIGS. 1A, 2A, and 3A and formed of A380 will have similar mechanical properties to the engine mounts 10, 10', 10" formed according to the designs shown in FIGS. 1B, 2B, and 3B and formed of the aluminum alloy composition disclosed herein, except that each of the designs 12, 12', 12" shown in FIGS. 1A, 2A, and 3A requires more of the A380 alloy in order to achieve these properties. For example, the design of FIG. 1B utilizes about 122 grams less of the aluminum alloy composition disclosed herein compared to the amount of A380 used in the design of FIG. 1A (see the circled portions). For another example, the design of FIG. 2B utilizes about 63 grams less of the aluminum alloy composition disclosed herein compared to the amount of A380 used in the design of FIG. 2A (see the circled portions). For still another example, the design of FIG. 3B utilizes about 107 grams less of the aluminum alloy composition disclosed herein compared to the amount of A380 used in the design of FIG. 3A (see the circled portions).

While several illustrations of engine mounts 10, 10', 10" have been provided, it is to be understood that the aluminum alloy disclosed herein is not limited to being used for forming engine mounts, or even chassis components. Rather, the aluminum alloy disclosed herein may be used to form any desired aluminum casting, and in particular, any thin-walled aluminum casting. Other examples include aircraft fittings, gears, shafts, bolts, clock parts, computer parts, couplings, fuse parts, hydraulic valve bodies, nuts, pistons, fastening devices, veterinary equipment, orthopedic equipment, etc.

To further illustrate the present disclosure, an example is given herein. It is to be understood that this example is provided for illustrative purposes and is not to be construed as limiting the scope of the present disclosure.

EXAMPLE

Comparative structural castings were formed from SF36 (aluminum alloy composition containing 10 wt % silicon, 0.6 wt % manganese, and 0.3 wt % magnesium and does not include copper, chromium, or titanium) (comparative example 1) and A379 (the composition of which is shown in TABLE 1 and does not include copper) (comparative example 2). Both of these alloys, in molten form, were cast using HPDC. Comparative example 1 was exposed to a T7 heat treatment. Comparative example 2 was exposed to a T5 heat treatment.

An example structural casting formed from the example aluminum alloy disclosed herein was cast using HPDC (with the same processing conditions that were used for the comparative examples) and was exposed to a T5 treatment (with the same processing conditions that were used for comparative example 2).

The composition of comparative example 2 and the example aluminum alloy are shown in TABLE 1.

TABLE 1

| | | Element | | | | | | | | | |
|---|---|---|---|---|---|---|---|---|---|---|---|
| Sample | | Si | Fe | Cr | Cu | Mg | Ti | Zn | P | Sr | Al |
| Example | Wt % | 7.5-9.5 | <0.15 | 0.25-0.35 | 0.1-3 | 0.1-0.5 | 0.05-0.1 | <0.01 | <0.003 | <0.01 | Bal. |
| Comparative Example 2 | Wt % | 7.5-9.5 | <0.15 | 0.25-0.35 | 0 | 0.1-0.5 | 0.05-0.1 | <0.01 | <0.003 | <0.01 | Bal. |

Yield strength, ultimate tensile strength, and percent elongation were taken for the as-cast comparative examples, and for the heat treated comparative examples and example. Tensile testing was performed at a quasi-static state, and measurements were made with an extensometer. The results are shown in TABLE 2.

TABLE 2

| Sample | | Yield Strength (MPa) | Ultimate Tensile Strength (MPa) | Elongation (%) |
|---|---|---|---|---|
| Comparative | As-cast | 140 | 210 | 6-8 |
| Example 1 | T7 treatment | 130 | 195 | 8.5-10 |
| Comparative | As-cast | 140 | 260 | 11-13 |
| Example 2 | T5 treatment | 190 | 310 | 9-11 |
| Example | T5 treatment | 220 | 330 | 7-9 |

As illustrated in TABLE 2, the structural casting formed from the aluminum alloy disclosed herein exhibits a higher yield strength and ultimate tensile strength and a comparable ductility/elongation when compared to other structural castings formed from other alloys using HPDC and T5 treatment and other structural castings formed from other alloys using HPDC and a T7 treatment. Comparative examples 1 and 2 do not include copper. Additionally, comparative example 1 does not include chromium or titanium.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood that the ranges provided herein include the stated range and any value or sub-range within the stated range. For example, a range from about 7.5 wt % to about 9.5 wt % should be interpreted to include not only the explicitly recited limits of from about 7.5 wt % to about 9.5 wt %, but also to include individual values, such as 7.55 wt %, 8.25 wt %, 8.9 wt %, etc., and sub-ranges, such as from about 7.75 wt % to about 9 wt %, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

The invention claimed is:

1. A chassis component for an automobile, the chassis component comprising an aluminum alloy consisting essentially of:

from greater than 6 wt % to about 12.5 wt % silicon;
iron present in an amount up to 0.15 wt %;
from about 0.1 wt % to about 0.4 wt % chromium;
from about 0.1 wt % to about 3 wt % copper;
from about 0.1 wt % to about 0.5 wt % magnesium;
from about 0.05 wt % to about 0.1 wt % titanium;
less than 0.01 wt % strontium;
less than 0.01 wt % zirconium;
less than 0.01 wt % zinc; and
a balance of aluminum and inevitable impurities;
wherein the aluminum alloy contains no vanadium or manganese.

2. The chassis component as defined in claim 1 wherein the inevitable impurities are selected from the group consisting of:

less than 0.01 wt % zinc;
less than 0.003 wt % phosphorous;
less than 0.01 wt % zirconium; and
combinations thereof.

3. The chassis component as defined in claim 1 wherein the chassis component is an as-cast and T5 treated structure of the aluminum alloy.

4. The aluminum alloy as defined in claim 3 wherein the as-cast and T5 treated structure of the aluminum alloy has a percent elongation ranging from about 7% to about 10% and a yield strength ranging from about 200 MPa to about 250 MPa.

5. The aluminum alloy as defined in claim 3 wherein the as-cast and T5 treated structure is a thin-wall casting.

6. The chassis component as defined in claim 3 wherein the as-cast and T5 treated structure has a thin-wall ranging from about 3 mm to about 5 mm.

7. A method for increasing ductility and strength of an aluminum alloy without using vacuum and a T7 heat treatment, the method comprising:

forming the aluminum alloy in a molten state, the aluminum alloy consisting essentially of:
from about 7.5 wt % to about 12.5 wt % silicon;
iron present in an amount up to 0.15 wt %;
from about 0.1 wt % to about 0.4 wt % chromium;
from about 0.1 wt % to about 3 wt % copper;
from about 0.1 wt % to about 0.5 wt % magnesium;
from about 0.05 wt % to about 0.1 wt % titanium;
less than 0.01 wt % strontium;
less than 0.01 wt % zirconium;
less than 0.01 wt % zinc;
0 wt % manganese;
0 wt % vanadium; and
a balance of aluminum and inevitable impurities; and casting the molten aluminum alloy by a high pressure die-cast process to form a cast structure, the cast structure being a chassis component for an automobile.

8. The method as defined in claim 7 wherein the high pressure die-cast process is carried out at a pressure of about 60 MPa to about 100 MPa.

9. The method as defined in claim 7, further comprising subjecting the cast structure to a T5 treatment at a temperature ranging from about 160° C. to about 210° C. for a time ranging from about 3 hours to about 6 hours.

10. The method as defined in claim 7 wherein the cast structure is a thin-wall casting.

11. The method as defined in claim 7 wherein the inevitable impurities are selected from the group consisting of:

less than 0.01 wt % zinc;
less than 0.003 wt % phosphorous;
less than 0.01 wt % zirconium; and
combinations thereof.

* * * * *